US006497004B1

(12) United States Patent
Armstrong

(10) Patent No.: US 6,497,004 B1
(45) Date of Patent: Dec. 24, 2002

(54) DELAYED ACTION DOOR HOLDER

(76) Inventor: Richard Armstrong, 449 Norris Landing Rd., Swansboro, NC (US) 28584

( * ) Notice: Subject to any disclaimer, the term of this patent is extended or adjusted under 35 U.S.C. 154(b) by 0 days.

(21) Appl. No.: 09/838,379

(22) Filed: Apr. 20, 2001

(51) Int. Cl.[7] ..... E05F 3/00

(52) U.S. Cl. ..... 16/66; 16/84

(58) Field of Search ..... 16/63, 65, 66, 16/70, 84, 86 A, 86 R, 85, 49, 71, 80; 292/341.12, DIG. 15; 248/205.7, 205.8, 205.5, 205.9, 206.2, 206.3

(56) References Cited

U.S. PATENT DOCUMENTS

| | | | | |
|---|---|---|---|---|
| 1,621,974 A | * | 3/1927 | Deenihan | 16/84 |
| 2,124,258 A | * | 7/1938 | Moecker | 126/214 R |
| 2,908,032 A | * | 10/1959 | Hatch | 16/80 |
| 3,042,958 A | * | 7/1962 | Spears | 16/84 |
| 3,579,709 A | * | 5/1971 | Pierie | 16/333 |
| 3,863,568 A | * | 2/1975 | Frederick | 102/411 |
| 3,877,108 A | * | 4/1975 | Del Fiacco | 16/49 |
| 4,042,126 A | * | 8/1977 | Blauvelt et al. | 271/107 |
| 4,053,961 A | | 10/1977 | Wilson et al. | 16/84 |
| 4,130,083 A | * | 12/1978 | Bouchard et al. | 116/105 |
| 4,141,104 A | * | 2/1979 | Watson | 16/65 |
| 4,505,502 A | | 3/1985 | Tomita | 292/251.5 |
| 5,271,652 A | * | 12/1993 | Watanabe et al. | 105/378 |
| 5,293,666 A | | 3/1994 | Armstrong | 16/66 |
| 5,855,039 A | * | 1/1999 | Crawford | 16/49 |

FOREIGN PATENT DOCUMENTS

| | | | |
|---|---|---|---|
| CN | 686148 A5 | * | 1/1996 |
| JP | 9-177411 | * | 7/1997 |

* cited by examiner

*Primary Examiner*—Chuck Y. Mah
(74) *Attorney, Agent, or Firm*—Roylance, Abrams, Berdo & Goodman, L.L.P.

(57) ABSTRACT

An apparatus for holding open a door or similar member for a predetermined time period includes a suction mechanism coupled to the door and the door frame. The suction mechanism includes an adjustable valve to provide a controlled flow of air to release the suction. The mechanism includes an arm having a suction cup at one end and a suction plate pivotally connected to the arm for engaging the suction cup when the door is in the open position. The suction mechanism is attached to the inner surface of the door and the necessary relative motions of parts achieved by an articulated connecting rod and suction cup pad assembly are pivotally attached to the adjacent door frame. The articulated assembly permits the face of the suction cup and its target to be parallel to the door in the open and closed positions. The arm is connected to a spring loaded mounting assembly so that the door's maximum opening limitation is dictated by the spring closing mechanism or other motion limiting device.

25 Claims, 4 Drawing Sheets

DELAYED ACTION DOOR HOLDER

FIELD OF THE INVENTION

The present invention is directed generally to an apparatus for holding a door or similar member in an open position for a predetermined period of time, after which the door is returned to the closed position. More particularly, the invention is directed to a delayed action suction operated device for holding a door in an open position for a selected period of time.

BACKGROUND OF THE INVENTION

Doors and gates are often provided with an automatic closing assembly for maintaining the door in a closed position. The automatic door closing apparatus are typically spring operated, pneumatically operated or hydraulically operated systems. Although many of these automatic door closing systems close the door at a controlled rate, these devices generally do not have a system for holding the door in an open position.

In an effort to control the closing operation of the automatic door closing assembly, various devices have been proposed to hold the door in an open position for a predetermined period of time. For example, U.S. Pat. No. 4,053,961 discloses a suction cup that is attached to the back of a door. The suction cup is positioned so that the suction cup mates with an adjacent wall when the door is open. The suction cup is allowed to leak to release the suction and allow the door to close. The suction cup can be provided with small holes to allow the controlled flow of air into the suction cup. Alternatively, the mating wall can be provided with holes to allow air to flow into the suction cup. A disadvantage of this device is that the suction cup relies on the adjacent wall for the operation of the door holding assembly. Therefore, this assembly cannot be used in situations where there is no adjacent wall.

Another example of a device for holding a door in an open position is disclosed in U.S. Pat. No. 3,042,958. This device includes a suction cup coupled to the back side of a door which mates with a complementing suction cup mounted on a wall. This device has the disadvantage of requiring a suction cup mounted directly to the wall, thereby damaging the wall. In addition, the suction cup mounted to the wall must be precisely located to mate with the suction cup on the door to ensure proper operation of the assembly.

Still another example of a device for holding a door in an open position is disclosed in U.S. Pat. No. 5,293,666 to Armstrong. This device includes a suction mechanism for holding a door in an open position for a period of time. The assembly is mounted between the door and the door jamb and includes a suction cup mounted to the door and a plate for mating with the suction cup. The plate is mounted to engage the suction cup when the door is open and to hold the door in the open position. A valve can be provided in the plate to control the release of the vacuum in the suction cup to release the suction and allow the door to close. In this device, the plate is oriented substantially perpendicular to the plane of the door and extends outwardly from the door throughout the operation of the assembly. The suction cup has a center axis oriented generally parallel to the door and perpendicular to the mating plate. A disadvantage of this assembly is the orientation of the suction cup and the plate which extend outwardly from the door a depth at least equal to the diameter of the suction cup. The average space between a storm door and an exterior door of a house is generally about 2.5 inches. This space limits the size of the suction cup that can be used to hold the door in an open position when the suction cup is oriented along an axis parallel to the door.

Although the above-noted devices have exhibited some success, there is a continuing need in the industry for an improved delayed door holding device.

SUMMARY OF THE INVENTION

The present invention is directed to an apparatus for holding a door or other member in an open position for a predetermined period of time. More particularly, the invention is directed to a delayed action suction operated device for holding a door in an open position against the force of a door closing mechanism.

Accordingly, a primary object of the invention is to provide a suction operated device for holding a door in an open position.

Another object of the invention is to provide a delayed action door holding device having a dimension to fit within the space between an exterior door and a storm door.

A further object of the invention is to provide a delayed action door holding device that is mounted to the door and to the door jamb for holding the door in an open position against the force of an automatic door closing assembly.

Still another object of the invention is to provide a delayed action door holding device having a suction cup and a mating surface for the suction cup where the mating surface and the suction cup are oriented in a plane generally parallel to the door when the door is in an open and closed position.

Another object of the invention is to provide a delayed action door holding device having a first arm pivotally connected to a door jamb and a second arm pivotally connected to the first arm and to the door where the first arm includes a suction cup and the second arm includes a mating surface for coupling to the suction cup.

Still another object of the invention is to provide a delayed action door holding device having a mounting bracket for mounting the device to a door jamb where the bracket is spring biased to allow the door to open beyond a predetermined point without damaging the device.

The objects and advantages of the invention are basically attained by providing an apparatus for retaining a movable member in a fixed position for a predetermined period of time. The apparatus comprises a first arm having a suction cup coupled thereto. A plate is pivotally coupled to the first arm which has a surface for mating with the suction cup. The plate is pivotable by movement of the member between a first position spaced from the suction cup and a second position contacting and temporarily attaching to the suction cup and holding the movable member in the fixed position.

The objects and advantages of the invention are further attained by providing an apparatus for temporarily holding a pivotally mounted door in an open position. The apparatus comprises a first arm having a first end for pivotally coupling to a door frame and also having a second end. A second arm has a first end for pivotally coupling to a door and a second end pivotally coupled to the second end of the first arm. The second arm is pivotable with respect to the first arm between a first position when the door is in a closed position and a second position when the door is in an open position. A suction cup is positioned to temporarily hold the second arm in the second position and to hold the door in the open position.

The objects and advantages of the invention are also attained by providing an apparatus for temporarily holding a member in a first position for a period of time. The member is pivotally coupled to a support. The apparatus comprises a first arm having a first end pivotally coupled to the support and having a second end. A second arm has a first end pivotally coupled to the member and a second end pivotally coupled to the second end of the first arm. The second arm is pivotable between a first position and a second position by pivotal movement of the member with respect to the support. A coupling member for temporarily holding the second arm in the second position is provided.

The objects advantages and salient features of the invention will become apparent from the following detailed description in conjunction with the annexed drawings which form a part of this original disclosure.

BRIEF DESCRIPTION OF THE DRAWINGS

The following is a brief description of the drawings in which.

DETAILED DESCRIPTION OF THE INVENTION

The present invention is directed to an apparatus for holding a door or other member in an open position against the closing force of the door. The apparatus is particularly suitable for use on a door, gate or other member that is pivotally mounted to a support structure.

Figure 1:
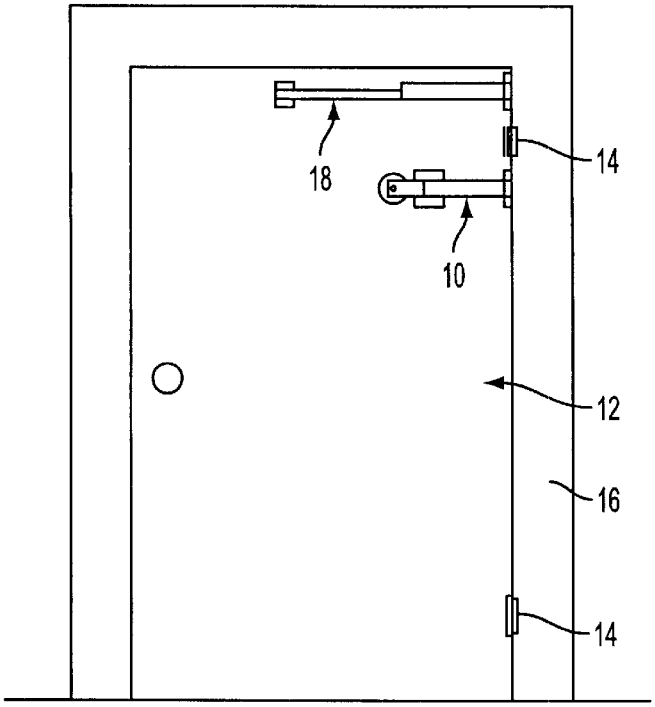
FIG. 1 is a front view of a door mounted to a door frame and showing the automatic door closing assembly and the delayed action door holder of the invention.

Referring to FIG. 1, the delayed action door holder assembly 10 is coupled to a door 12 mounted by hinges 14 to a door frame 16. Apparatus 10 is primarily used in conjunction with an automatic door closing assembly 18. Closing assembly 18 is a standard door closing assembly as known in the art. Door closing assembly 18 can be, for example, a pneumatically operated device, spring operated device or hydraulic operated device that can be mounted to a door and the accompanying door frame for automatically closing the door.

Figure 2:
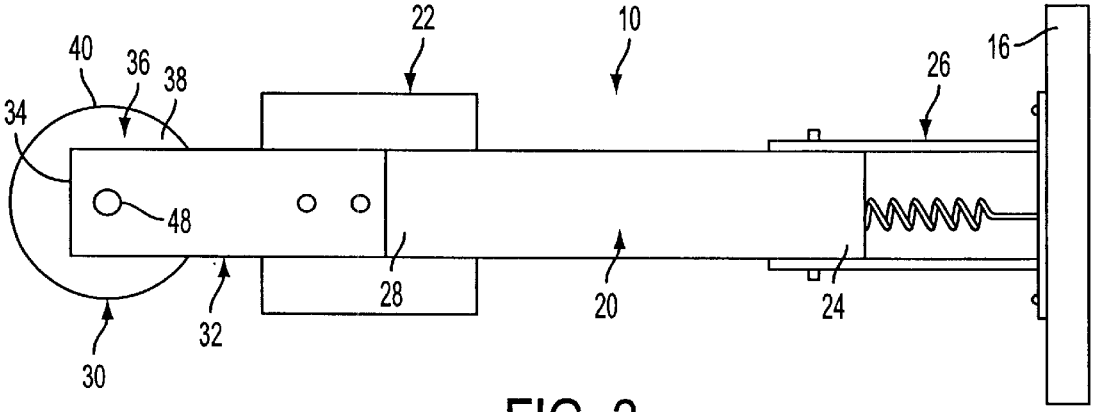
FIG. 2 is a front view of the delayed action door holder of the invention in one embodiment.
Figure 3:
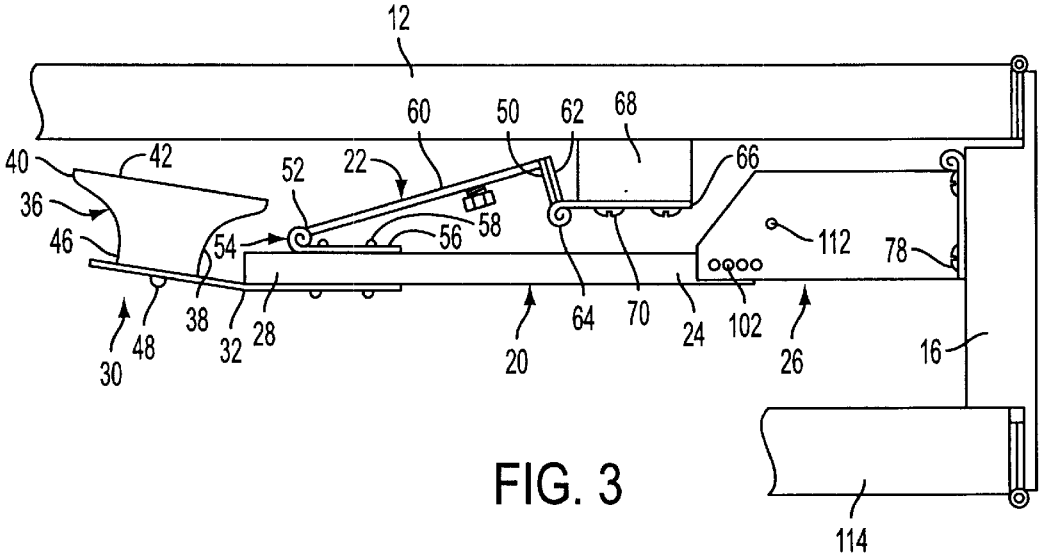
FIG. 3 is a top view of the delayed action door holder device of FIG. 2 showing the door in the closed position.

Referring to FIGS. 2 and 3, assembly 10 includes a first arm 20 coupled to door frame 16 and a second arm 22 coupled to door 12. In the embodiment illustrated, first arm 20 has a first end 24 pivotally connected to a mounting assembly 26. In the embodiment illustrated, mounting assembly 26 is mounted to door frame 16 to enable first arm 20 to pivot with respect to door frame 16. First arm 20 includes a second end 28 spaced from first end 24 and includes a coupling member 30 for holding door 12 in an open position as discussed hereinafter in greater detail.

In a preferred embodiment of the invention, coupling member 30 includes a mounting bracket 32 coupled to second end 28 of first arm 20. Mounting bracket 32 can be attached to first arm 20 by screws, bolts or other fasteners as known in the art. Coupling bracket 32 has an outer end 34 spaced from second end 28 of first arm 20. A suction cup 36 is coupled to outer end 34 of mounting bracket 32 as shown in FIG. 3.

Figure 6:
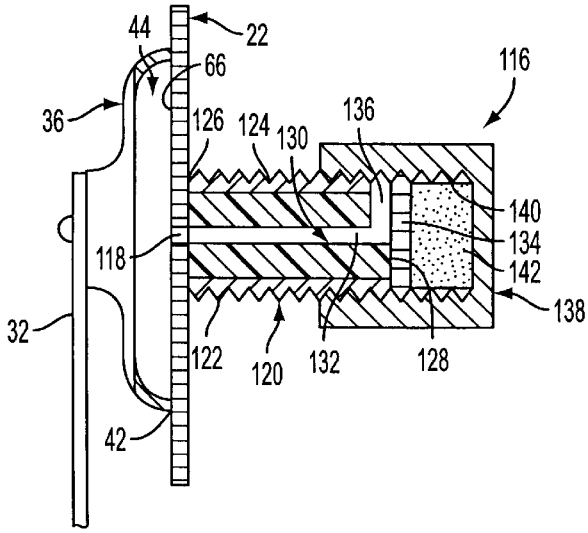
FIG. 6 is a partial cross-sectional side view of the coupling plate showing the vacuum relief valve assembly in one embodiment of the invention.

Suction cup 36 has a generally frustoconical shaped side wall 38 that is flared outwardly to a substantially circular end 40 forming a sealing surface 42. Side wall 38 of suction cup 36 defines an internal cavity 44 as shown in FIG. 6. Suction cup 36 is made from a resilient rubber-like material that can attach to a mating surface. Suction cup 36 has a top end 46 that is connected to outer end 34 of mounting bracket 32 by a fastener 48. Fastener 48 can be a screw, rivet or other device capable of coupling suction cup 36 to mounting bracket 32.

Second arm 22 has a first end 50 that is pivotally connected to door 12 and a second end 52 connected to first arm 20. As shown in FIG. 3, second arm 22 includes a hinge 54 at second end 52. Hinge 54 in the embodiment illustrated is integrally formed with second arm 22 and includes a leg 56 that is coupled to first arm 20. Leg 56 can be coupled to first arm 20 by a fastener 58 or by other means as known in the art. Second arm 22 in preferred embodiments, has a substantially planar configuration forming a plate for mating with suction cup 36 as discussed hereinafter in greater detail. Typically, second arm 22 has a generally square configuration with a dimension at least equal to the dimensions of sealing surface 42 of suction cup 36 and having a mating surface 60 for mating with suction cup 36. In the embodiment illustrated, first end 50 of second arm 22 has a leg 62 extending substantially perpendicular to the plane of second arm 22. Leg 62 extends outwardly from second arm 22 and is coupled to a hinge 64. In one embodiment of the invention, hinge 64 is integrally formed with leg 62 and includes a flange 66 for mounting hinge 64 to door 12.

In a preferred embodiment, a mounting block 68 is coupled to door 12 and flange 66 of hinge 64 is coupled to mounting block 68. Typically, flange 68 is coupled to mounting block 68 by screws 70 or other suitable fasteners. Mounting block 68 has a thickness at least equal to the width of leg 62 of second arm 22. Mounting block 68 is dimensioned to space flange 66 from door 12 a distance to prevent second arm 22 from interfering with door 12 during the opening and closing of the door.

Figure 4:
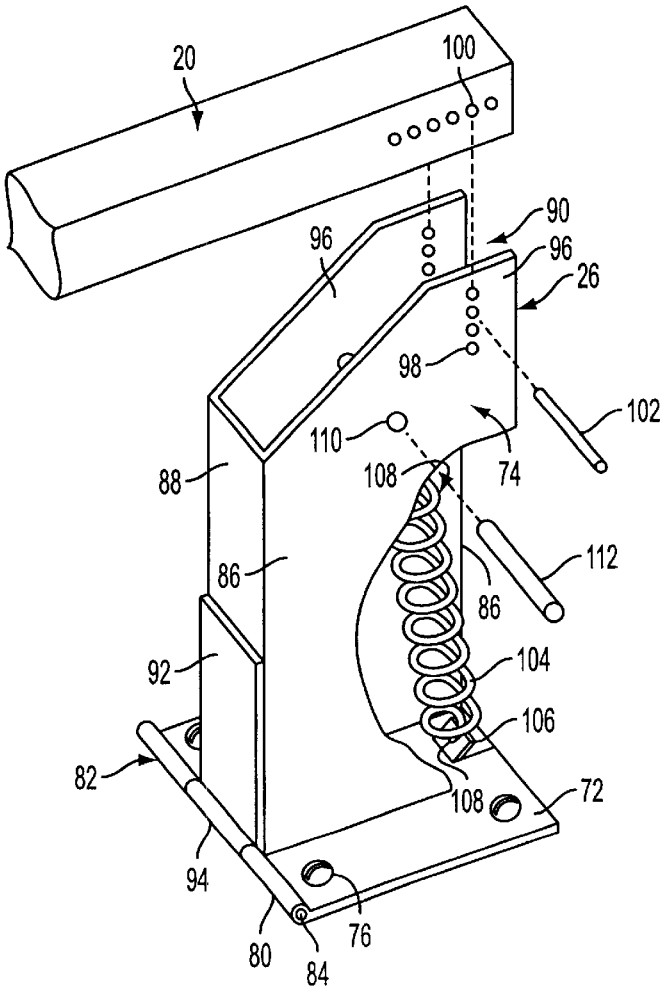
FIG. 4 is a partial perspective view of the mounting bracket assembly of the delayed action door holder of FIG. 2.

Referring to FIG. 4, mounting assembly 26 includes a base 72 and a body 74. Base 72 has a substantially planar configuration having apertures 76 for receiving screws 78 or other fastener for attaching base 72 to door frame 16 as shown in FIG. 3. Base 72 includes a cylindrical portion 80 defining a hinge 82 having a hinge pin 84 for coupling body 74 to base 72.

Body 74 has a pair of opposing side walls 86, an end wall 88 extending between side walls 86, and an open side 90. End wall 88 includes a flange 92 having a cylindrical section 94 for coupling with hinge 82. Hinge pin 84 extends through cylindrical portion 94 of flange 92 and cylindrical portion 80 of base 72 to pivotally connect body 74 to base 72.

Side walls 86 have a height greater than end wall 88 as shown in FIG. 4 to define a tab section 96. Tab sections 96 of side walls 86 have a plurality of apertures 98 arranged in a row extending in a longitudinal direction with respect to a longitudinal dimension of body 74. As shown in FIG. 4, first arm 20 includes a plurality of spaced apart apertures 100 that can be aligned with apertures 98. A pin 102 is provided to extend through apertures 98 and 100 for pivotally connecting first arm 20 to mounting assembly 26.

Body 74 is biased to base 72 by a spring 104 extending between base 72 and body 74. In one embodiment of the invention, base 72 is provided with a tab 106 having an aperture 108 for coupling to a lower end of spring 104. Side walls 86 are provided with apertures 110 for receiving a pin 112. Pin 112 extends through apertures 110 for coupling to an upper end of spring 104. In this manner, body 74 is spring biased against base 72 while allowing body 74 to pivot with respect to base 72 by hinge 82.

Assembly 10 is mounted to a door 12 and door frame 16 substantially as shown in FIG. 3. In preferred embodiments, base 72 of mounting assembly 26 is fixed to door frame 16 and is oriented to extend substantially parallel to door 12 when door 12 is in the closed position as shown in FIG. 3. Mounting block 86 is then coupled to door 12. The operating length of first arm 20 and the position of mounting block 68 can be adjusted by selecting an aperture 98 and 100 of first arm 20 and side walls 86, respectively, for coupling first arm 20 to mounting assembly 26. The operating length of first arm 20 is primarily to accommodate various thicknesses of doors which effects the distance between the pivot point of door hinge 115 and mounting base 72. As shown in FIG. 3, door 12 is in the normally closed position with first arm 20 and second arm 22 extending in a generally parallel direction to door 12. Suction cup 36 is also oriented with the sealing surface 42 facing door 12. As shown in FIG. 3, assembly 10 has a dimension to fit within the space between door 12 and a second door 114 mounted to a common door frame 16. Typically, one of doors 12 and 114 is a storm door and the other is an exterior door of a building.

Figure 5:
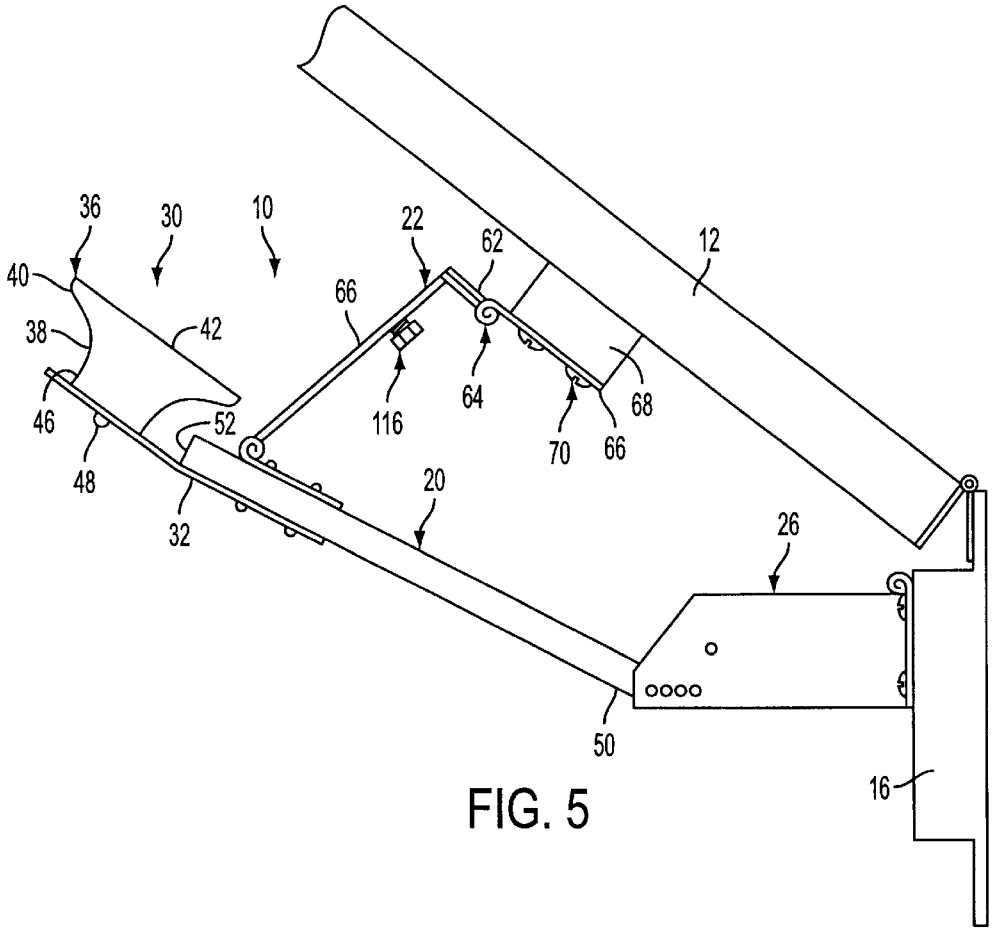
FIG. 5 is a top view of the delayed action door holder showing the door in the partially open position.
Figure 7:
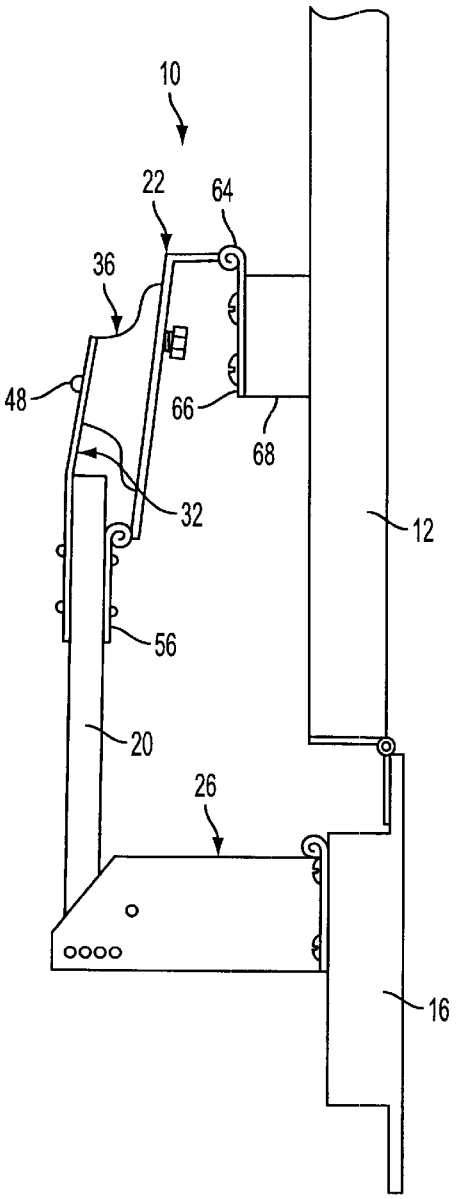
FIG. 7 is a top view of the delayed action door holder with the door in the open position.

Apparatus 10 is normally used in conjunction with a closing assembly 18 for automatically closing door 12 as shown in FIG. 1. Referring to FIG. 5, as door 12 is opened with respect to door frame 16, first arm 20 pivots with respect to mounting assembly 26. Second arm 22 pivots about hinge 64 with respect to mounting block 68 and pivots about hinge 54 with respect to first arm 20. As shown in FIG. 5, second arm 22 pivots toward sealing surface 42 of suction cup 36. Door 12 can be opened to a position shown in FIG. 7 where door 12 is substantially parallel to door frame 16. In this position, second arm 22 engages sealing surface 42 of suction cup 36 with sufficient force to attach suction cup 36 to the mating surface 60 of second arm 22. Suction cup 36 is dimensioned to attach to mating surface 60 with sufficient strength to hold mating surface 60 of second arm 22 against suction cup 36 against the closing force of door closing assembly 18. Suction cup 36 can remain coupled to mating surface 60 of second arm 22 for an extended period of time to hold door 12 in the open position. A manual force can be applied to door 12 to separate suction cup 36 from mating surface 60 of arm 22 to release apparatus 10 and allow the automatic door closing assembly 18 to close door 12.

In preferred embodiments of the invention, apparatus 10 includes a vacuum relief valve 116 coupled to second arm 22. In the embodiment illustrated, second arm 22 includes a passage 118 oriented to communicate with cavity 44 of suction cup 36 when suction cup 36 engages mating surface 60 of second arm 22. In one embodiment, passage 118 can have a sufficiently small dimension to allow the slow diffusion of air through passage 118 into cavity 44 to release the vacuum caused by suction cup 36 and enable suction cup 36 to separate from mating surface 60. In alternative embodiments, a passage can be formed to extend through a top side of suction cup 36.

In the embodiment illustrated, relief valve assembly 116 is coupled to second arm 22 to control the flow of air through passage 118. In one embodiment, vacuum relief valve 116 includes an outer cylindrical sleeve 120 having external threads 122 and an internal axial passage 124 extending between a first end 126 and a second end 128. External threads 122 are typically tapered common pipe threads. Cylindrical sleeve 120 includes an inner sleeve 130 having an axial passage 132 communicating with passage 118 of second arm 22. Axial passage 132 extends to an outer end 134 of inner sleeve 130. In the embodiment illustrated, a radially extending passage 136 extends from axial passage 134 outwardly to the side edge of inner sleeve 130.

A closure member 138 having internal threads 140 is coupled to sleeve 120 to close axial passage 132. Internal threads 140 are typically tapered common pipe threads as in standard pipe cap fittings. In the embodiment illustrated, closure member 138 is a cap having an inner sleeve 142 formed from a resilient and compressible sponge-like material and a non-porous seal member 144. Inner sleeve 142 is dimensioned to reduce the volume of air trapped under suction cup 36. Closure member 132 is threaded onto sleeve 120 to restrict the flow of air through axial passage 132. The flow of air through vacuum relief valve 116 is controlled by tightening of closure member 142, which reduces the flow of air between the tapered threads 122 and 140. In an alternative embodiment, the resilient member 142 is compressed by tightening a closure member to apply a pressure against seal 144 to control the flow of air through axial passage 132. Preferably, internal threads 140 of closure member 138 mate with external threads 122 in a manner to allow a limited flow of air between the threads and into axial passage 132. Tightening closure member 138 onto cylinder 120 enables a controlled flow of air between the threads to control the length of time that suction cup 36 is coupled to mating surface 60 of second arm 22.

Figure 8:
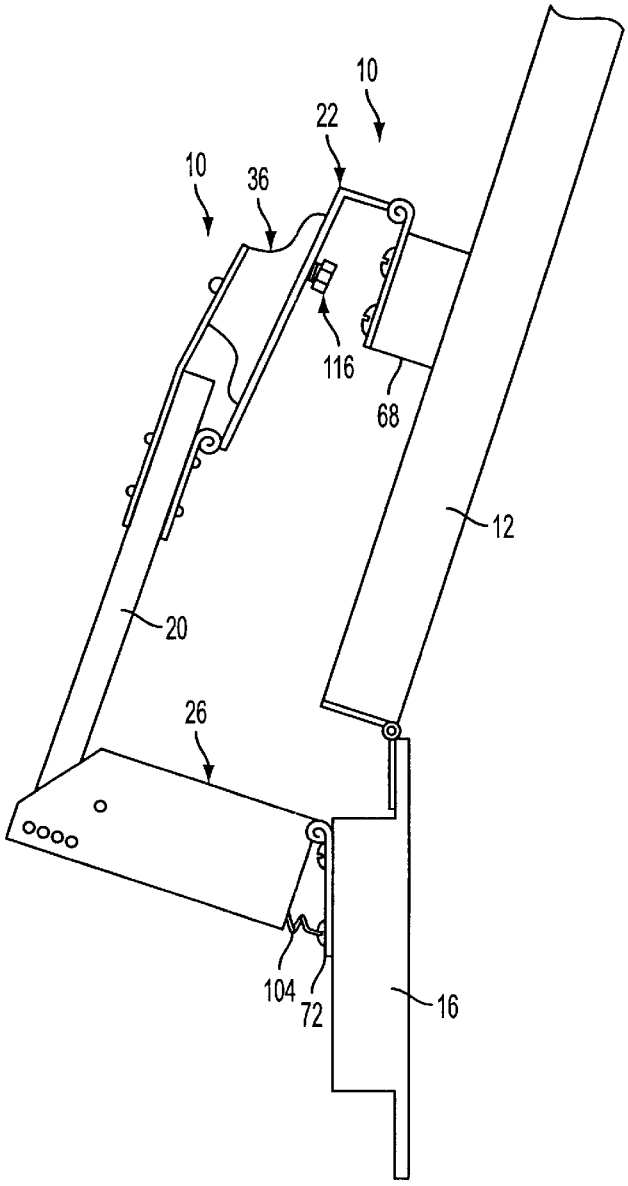
FIG. 8 is a top view of the delayed action door holder showing the door in an open position to pivot the mounting bracket about the base.

Referring to FIG. 8, mounting assembly 26 does not restrict the movement of door 12 with respect to door frame 16. As door 12 pivots past the point where suction cup 36 engages mating surface 60 of arm 22, body 86 is able to pivot about hinge 82 with respect to base 72 as shown in FIG. 8. Spring 104 biases body 74 toward base 72 to return door 12 to the position shown in FIG. 7.

While a single embodiment has been chosen to illustrate the invention, it will be appreciated that various changes and modifications can be made to the assembly of the invention without departing from the scope of the invention as defined in the appended claims.

What is claimed is:

1. An apparatus for retaining a movable member in a fixed position for a predetermined period of time, said apparatus comprising:

a first arm having a suction cup coupled thereto; and a plate pivotally coupled to said first arm and having a surface for mating with said suction cup, said plate being pivotable between a first position spaced from said suction cup and a second position contacting and temporarily attaching to said suction cup by movement of said movable member and holding said movable member in said fixed position.

2. The apparatus of claim 1, wherein said movable member is a door hinged to a door frame, and wherein said first arm has a first end and a second end, said first end being pivotally coupled to said door frame.

3. The apparatus of claim 2, further comprising a second arm having a first end and a second end, said first end being pivotally coupled to said door and said second end being pivotally coupled to said second end of said first arm, and wherein said plate is coupled to said second arm and oriented to mate with said suction cup.

4. The apparatus of claim 2, further comprising a mounting assembly coupled to said first end of said first arm and coupled to said door frame, said mounting assembly including a base, a body pivotally coupled to said base and a biasing member for biasing said body with respect to said base.

5. The apparatus of claim 4, wherein said biasing member is a spring extending between said base and said body to bias said body toward said base.

6. The apparatus of claim 3, wherein said suction cup and said plate are substantially parallel to said door when said plate is in said first position and said second position.

7. The apparatus of claim 1, further comprising a vacuum relief valve assembly to allow a controlled flow of air into a cavity of said suction cup and to provide a controlled release of said suction cup from said plate.

8. The apparatus of claim 7, wherein said valve assembly is coupled to said plate.

9. The apparatus of claim 8, wherein said plate includes an aperture in communication with said valve assembly, said valve assembly including a body having a first end coupled to said plate, a second end spaced from said first end, an axial passage extending between said first and second ends, and an adjustable closure member to close said second end and control the flow of air through said axial passage.

10. The apparatus of claim 9, wherein said body of said vacuum relief valve assembly has external threads and said closure member has internal threads for coupling to said body.

11. The apparatus of claim 10, wherein said internal threads of said closure member are tapered to allow a controlled flow of air through said vacuum relief valve assembly.

12. An apparatus for temporarily holding a pivotally mounted door in an open position, said apparatus comprising:

a first arm having a first end for pivotally coupling to a door frame and having a second end;

a second arm having a first end for pivotally coupling to a door and a second end pivotally coupled to said second end of said first arm, said second arm being pivotable with respect to said first arm between a first position when said door is in a closed position and a second position when said door is in an open position; and a suction cup coupled to said apparatus to temporarily couple said first arm and said second arm together in a fixed position to prevent pivotal movement between said first arm and said second arm to hold said door temporarily in said open position.

13. The apparatus of claim 12, wherein said suction cup is coupled to said first arm and wherein said second arm includes a coupling surface for mating with said suction cup.

14. The apparatus of claim 13, wherein said coupling surface of said second arm is oriented substantially parallel to said door when said arm is in said first position and said second position.

15. The apparatus of claim 12, further comprising a mounting bracket assembly for pivotally coupling said first arm to said door frame.

16. The apparatus of claim 15, wherein said mounting bracket assembly comprises a base for coupling to said door frame and a body pivotally coupled to said base and being pivotable from a first position where said body abuts said base to a second position and including a spring to bias said body toward said first position.

17. The apparatus of claim 13, further comprising a vacuum relief valve assembly for controlling the flow of air to a cavity of said suction cup.

18. The apparatus of claim 17, wherein said vacuum relief valve assembly is coupled to said second arm, and includes a valve body with a first end coupled to said second arm and a second end spaced from said first end, an axial passage extending between said first end and said second end, and a threaded closure member coupled to said second end for controlling the flow of air through said vacuum relief valve assembly.

19. An apparatus for temporarily holding a member in a first position for a period of time, said member being pivotally coupled to a support, wherein said apparatus comprises:

a first arm having a first end pivotally coupled to said support and having a second end;

a second arm having a first end pivotally coupled to said member and a second end pivotally coupled to said second end of said first arm, said second arm being pivotable between a first position and a second position by pivotal movement of said member with respect to said support; and a coupling member for temporarily coupling said first arm to said second arm to prevent pivotal movement between said first arm and said second arm, thereby temporarily holding said second arm in said second position, thereby temporarily holding said member in said first position.

20. The apparatus of claim 19, wherein said coupling member is a suction cup.

21. The apparatus of claim 20, wherein said suction cup is coupled to said first arm.

22. The apparatus of claim 21, wherein said second arm includes a plate for mating with said suction cup.

23. The apparatus of claim 19, further comprising a mounting bracket for pivotally coupling said first end of said first arm to said support.

24. The apparatus of claim 23, wherein said mounting bracket comprises a base coupled to said support and a body pivotally coupled to said base, said base being pivotable from a first position abutting said base to a second position spaced from said base, and a spring for biasing said body to said first position.

25. The apparatus of claim 19, wherein said member is a door and said support is a door frame.

* * * * *